US005331753A

United States Patent [19]

Rodibaugh

[11] Patent Number: 5,331,753

[45] Date of Patent: Jul. 26, 1994

[54] PERSONALIZED SIGNATURE SHOES

[76] Inventor: Albert C. Rodibaugh, 2770 Bertha St., Bethel Park, Pa. 15102

[21] Appl. No.: 47,249

[22] Filed: Apr. 13, 1993

Related U.S. Application Data

[63] Continuation of Ser. No. 780,124, Oct. 21, 1991, abandoned.

[51] Int. Cl.[5] ..... A43B 23/00; A44C 3/00

[52] U.S. Cl. ..... 36/136; 36/132; 40/636

[58] Field of Search ..... 36/136, 132, 25 R; 40/618, 636

[56] References Cited

U.S. PATENT DOCUMENTS

| | | | |
|---|---|---|---|
| 47,438 | 4/1865 | Mackerley | 40/618 |
| 265,614 | 10/1882 | Kaufmann et al. | 40/618 |
| 438,179 | 10/1890 | Quarrie . | |
| 680,720 | 8/1901 | Le Lande | 40/618 |
| 1,079,402 | 11/1913 | Cornwall | 40/618 |
| 1,870,221 | 8/1932 | Babcock | 40/618 |
| 2,289,228 | 7/1942 | Warner | 40/618 |
| 2,616,189 | 11/1952 | Smith | 36/1 |
| 2,754,598 | 7/1956 | Aull | 36/1 |
| 2,775,834 | 1/1957 | Miller, Jr. | 40/624 |
| 2,995,849 | 8/1961 | Donnellan | 40/618 |
| 3,082,556 | 3/1963 | Schwartz et al. | 40/636 |
| 3,402,485 | 9/1968 | McMorrow | 36/25 |
| 3,538,628 | 11/1970 | Einstein, Jr. | 36/15 |
| 4,050,167 | 9/1977 | Senter | 36/32 R |
| 4,050,168 | 9/1977 | Pace | 36/136 |
| 4,619,125 | 10/1986 | Choi | 40/618 |
| 4,693,026 | 9/1987 | Callahan et al. | 40/618 |
| 4,712,314 | 12/1987 | Sigoloff | 36/112 |
| 4,837,960 | 6/1989 | Skata | 36/136 |
| 4,958,446 | 9/1990 | Brown | 36/11.5 |

FOREIGN PATENT DOCUMENTS

| | | | |
|---|---|---|---|
| 2454899 | 12/1980 | France | 36/136 |

*Primary Examiner*—Steven N. Meyers
*Attorney, Agent, or Firm*—J. Stewart Brams

[57] ABSTRACT

An article of footwear for imprinting personalized messages on a ground surface below, comprising: a flexible lower sole which is adapted to flex continually in use and including an elongated recessed track extending generally longitudinally of said lower sole, said track having closed ends and formed, longitudinally extending and spaced apart insert engaging portions; a plurality of adjoining separate, generally rectangular inserts each having a surface with a symbol, and a pair of generally parallel side portions with respective, opposed outer surfaces which are cooperable with said insert engaging portions, respectively; and said inserts being received into said recessed track with only said opposed outer surfaces engaging said insert engaging portions of said recessed track, respectively, in a manner that said inserts are retained in said recessed track by only partial perimeteral engagement of said inserts therewith throughout said flexing of said lower sole in use.

10 Claims, 3 Drawing Sheets

PERSONALIZED SIGNATURE SHOES

This is a continuation of co-pending application Ser. No. 07/780,124 filed on Oct. 21, 1991 now abandoned.

BACKGROUND OF THE INVENTION

This invention relates to an article of footwear, specifically to an improved method for imprinting symbols on a ground surface when walking.

BACKGROUND-DESCRIPTION OF PRIOR ART

Relating to footwear, the prior art shows us many attempts to invent a shoe that will leave a message or symbol on the ground as the wearer walks. An early U.S. Pat. No. 438,179 to Quarrie 1890 Oct. 14, was a cumbersome attachment which was screwed to a shoe. It required specially-made blocks for the message, and the wearer to carry a supply of ink.

U.S. Pat. Nos. 2,616,189 to Smith 1952 Nov. 4, and 2,754,598 to Aull 1956 Jul. 17, are similar identification plates which strap on the bottom of a shoe to leave a message in the ground below. They are not permanently attached and detract from the footwearer's appearance.

U.S. Pat. Nos. 3,402,485 to McMorrow 1968 Sep. 24, and 3,538,628 to Einstein, Jr. 1970 Nov. 10 have the entire sole impressed with a permanent design to be printed on the ground. To have a selection of designs there would be a need for different styles in each shoe size. This would create a costly inventory.

U.S. Pat. No. 4,050,167 to Senter 1977 Sep. 27 comprises of a three-dimensional inset which has to be assembled at the factory there by standardizing the design and limiting the choices or creating a costly inventory as above.

U.S. Pat. No. 4,050,168 to Pace 1977 Sep. 27 is a casual use sandal with pressure sensitive raised symbols attached to the bottom. Rugged use would be limited by these removable symbols.

And finally U.S. Pat. No. 4,958,446 to Brown 1990 Sep. 25 is a mass produced disposable sandal with the same message on each sole. This leaves the wearer with no choice in selecting his message.

Thus, there is a need for a footwear sole that can be personalized by the consumer to fit their taste which can be easily and inexpensively changed as new desires arise.

SUMMARY OF THE INVENTION

Accordingly, several objects and advantages of my invention are to overcome the abovementioned disadvantages and:

(a) to provide footwear that will leave a personalized symbol, letters or emblem, on the ground;

(b) to provide a changeable Personalized Signature Shoe where there is no need for straps, clamps, wire, or similar objectional material to hold symbols to shoes;

(c) to provide footwear that contains a hidden track in the bottom of the sole;

(d) to provide symbols, letter type, emblem type, and blank filler, shaped to fit this hidden sole track;

(e) to provide footwear that contains letter type, emblem type, and blank filler which is safely held in place by the flanged edge of the sole track;

(f) to provide footwear whereby the symbols can be changed;

(g) to provide footwear's symbols, letter type, emblem type with a notch for easy removal making changing the message a simple procedure.

Further objects and advantages are to provide footwear that can be personalized to a consumer's taste for a modest cost. This will be accomplished by standardizing the size and shape for the symbols, letter type, emblems and blank filler. Making this system interchangeable to fit all shoe sizes in a group (children, adult) will enable the cost per footwear to be kept to a minimum. In addition to low cost, extra sales will be gained as consumers taste change and the need for new symbols arise.

Still further objects and advantages of my invention will become apparent from a consideration of the drawings and ensuing description of it.

BRIEF DESCRIPTION OF THE DRAWINGS

In the drawings, closely related figures have the same number but different alphabetic suffixes.

REFERENCE NUMBERS IN DRAWINGS

Figure 1:
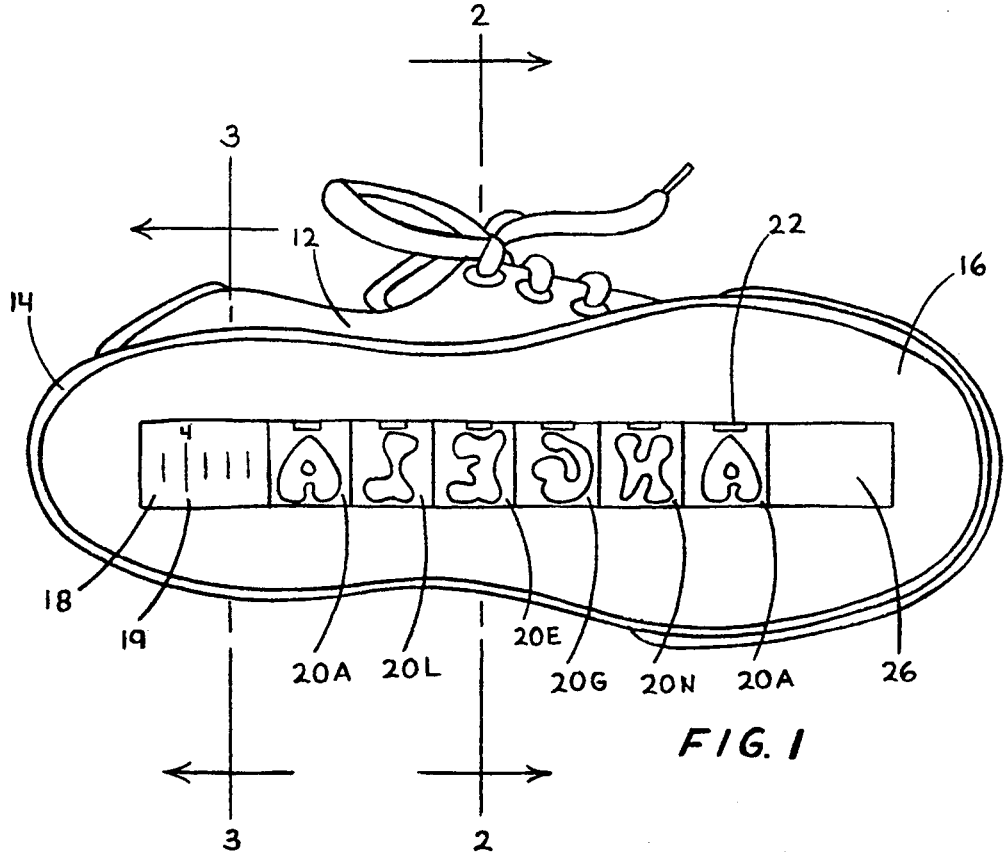
FIG. 1 shows a view of the bottom of footwear sole with insert letter type in sole track.

12 upper shoe portion
14 sole
16 lower sole
18 single beveled straight sole track
19 centering line scale
20 20*a*–20*z* letter type A–Z
22 notch for easy removal of letter type
24 single beveled side of letter type 20J
26 blank insert
28 double beveled letter type
30 double beveled sole track
32 convex edge letter type
34 concaved edged sole track
36 letter type with recessed area
38 outwardly bowed flanged sole track
40 circular recessed sole track
42 circular emblem type

DESCRIPTION OF THE PREFERRED EMBODIMENTS

Referring to the drawings, FIG. 1 illustrates a perspective view showing the bottom surface of a personalized signature shoe. Upper portion of footwear 12 is connected to sole 14. Lower sole 16 contains a recessed area 18 which is a straight single beveled track with a bottom flange designed to hold insert letter type 20A–20Z in place. Letter type 20A–20Z and bottom flange are made of a flexible material that allows them to be detachable when using grooved notch 22. Note on one end blank insert 26 fills track while other end is left empty leaving centering lines 19 exposed.

Figure 2:
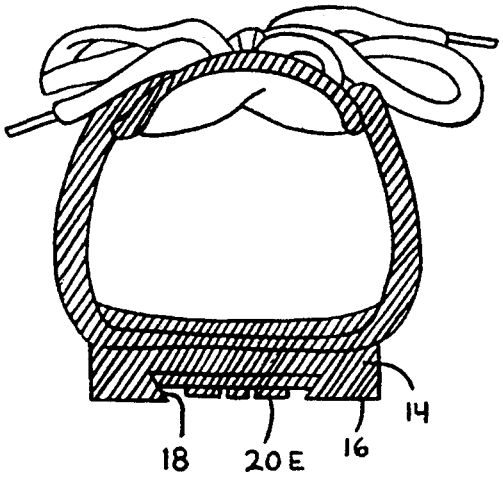
FIG. 2 shows a cross-sectional view taken along line 2—2 of FIG. 1 of footwear with insert letter type 20E in sole track.

FIG. 2 is a cross-sectional partial view taken along line 2—2 of FIG. 1. This view shows insert letter type 20E firmly secured in sole track because of matching side beveled edges.

Figure 3:
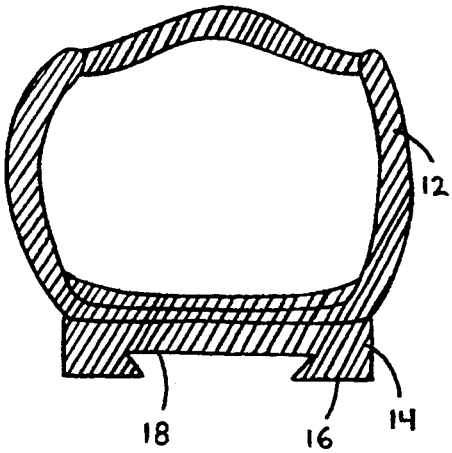
FIG. 3 shows a cross-sectional view taken along line 3—3 of FIG. 1 of footwear with no letter type in sole track.

FIG. 3 is a cross-sectional partial view taken along line 3—3 of FIG. 1. This section of sole track is empty. Flanged beveled side in track 18 is angled to hold letter type 20A–20Z firmly in place. The flanged beveled side is made of a firm but flexible material.

Figure 4:
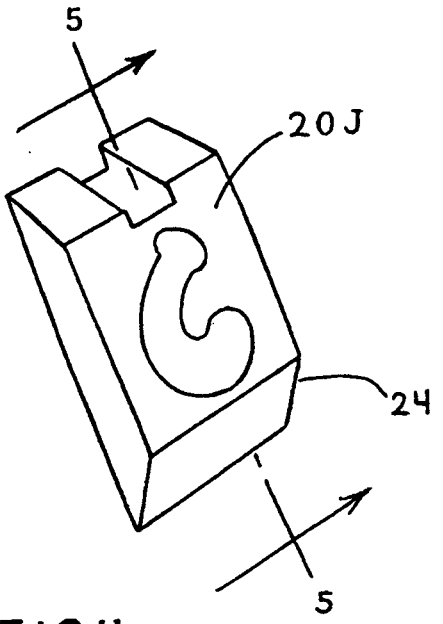
FIG. 4 shows a loose letter type 20J for sole track.

FIG. 4 shows loose letter J identified by number 20J. Letter type 20J is notched at 22 which makes it easily detachable.

Figure 5:
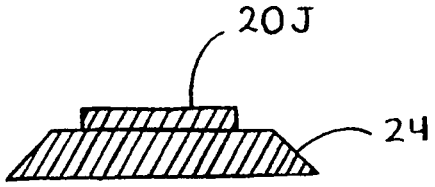
FIG. 5 side view of letter type 20J.

FIG. 5 is a cross-sectional view taken along line 5—5 of FIG. 4. Letter type 20J has a single beveled side 24 that correlates with beveled side in track 18 of FIG. 3. Letter type 20A–20Z are raised letters of a mirror image of the letter they represent. Put together they will form a mirror image of the word they imprint on the ground.

Figure 6:
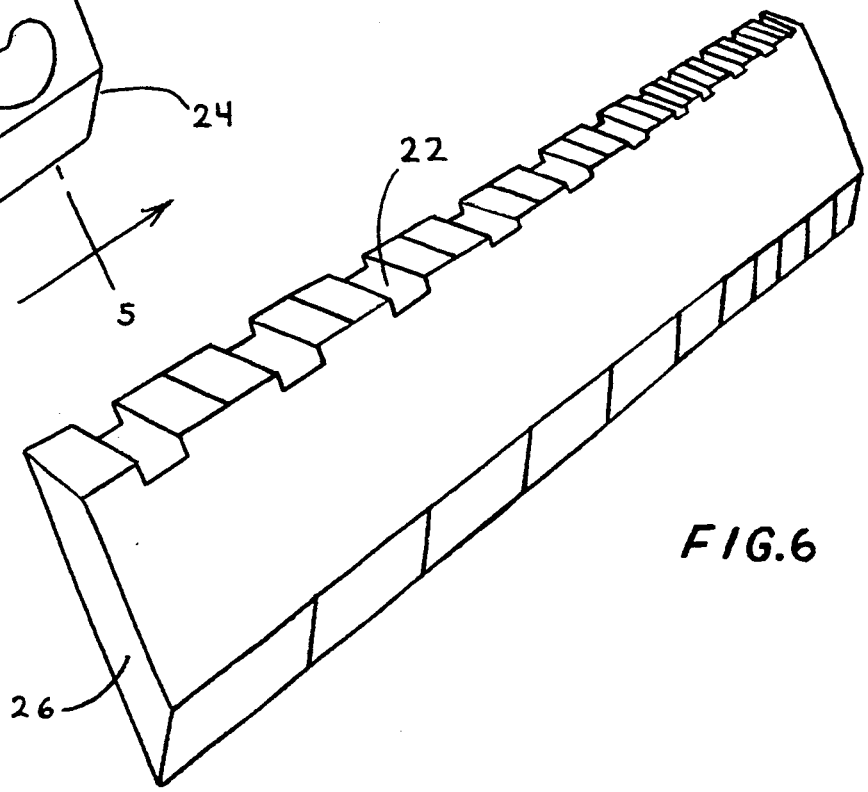
FIG. 6 shows blank insert.
Figure 7A:
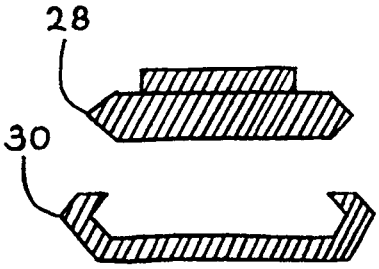
FIG. 7*a* thru 7*c* show additional designs for inserts and sole tracks.
Figure 7B:
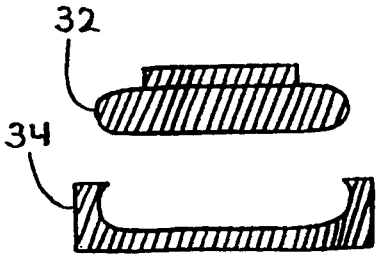
Figure 7C:
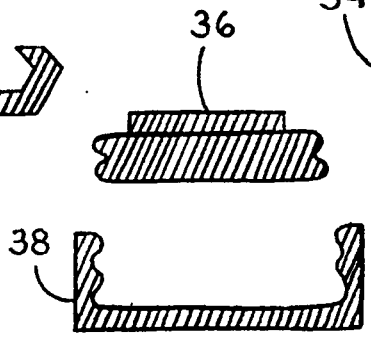

FIG. 6 shows blank insert 26 which has no raised letters. The blank insert can be of a thickness to be flush with the sole's lower surface or can be below its surface. Blank insert has the same angled single beveled side 24 as letter type 20J in FIG. 5.

FIG. *7a–7c* are additional designs for flexible detachable letter type and their accommodating sole track. FIG. *7a* shows double beveled side letter type 28 with double beveled sole track 30. FIG. *7b* shows a convex edge letter type numbered 32 which would be held firmly secured by its concaved edge sole track numbered 34. FIG. *7c* shows a detachable letter type with a curved recessed side numbered 36, which would be held securely in place by its outwardly bowed sole track numbered 38.

Figure 8:
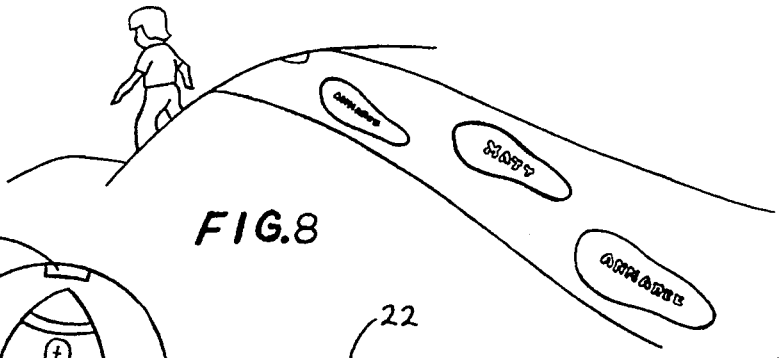
FIG. 8 shows imprint left by Personalized Signature Shoes.
Figure 9A:
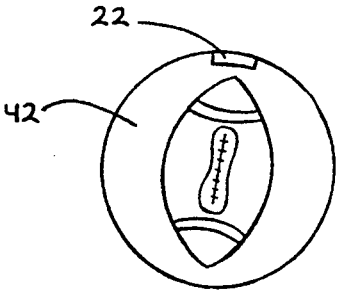
FIG. 9*a* thru 9*c* shows designs for inserts of the circular type.
Figure 9B:
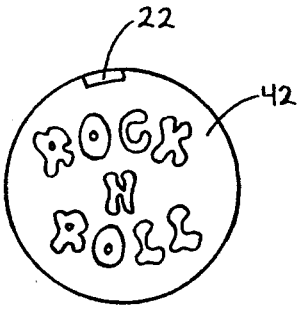
Figure 9C:
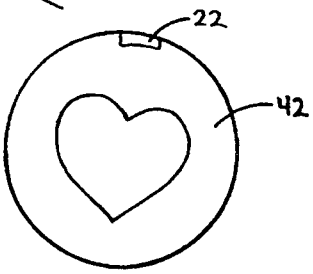

FIG. 8 illustrates possible imprint left from Personalized Signature Shoes.

FIG. *9a–c* shows 3 insert examples of circular emblems type numbered 42. There would be countless other designs possible. These circular emblem types are also made of a flexible material, and have notch 22 for easy replacement. There could also be a projection on the side of the circular emblem that would match a cut out area in the sole, keeping the emblem from turning in the track.

Figure 10:
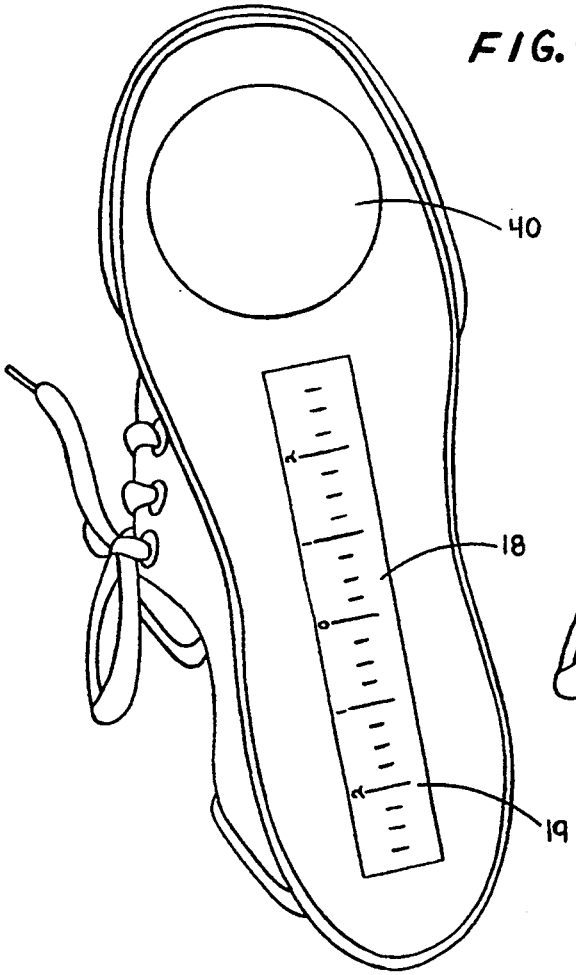
FIG. 10 shows an additional layout for footwear sole track. Note scale in sole track, centering lines for centering letter type.

FIG. 10 shows an additional sole design which combine a straight sole track 18 and a circular recessed track 40. The above tracks and symbols types could be made with a standard shape, size and track design determined by the manufacturer thereby making the system completely interchangeable.

Figure 11:
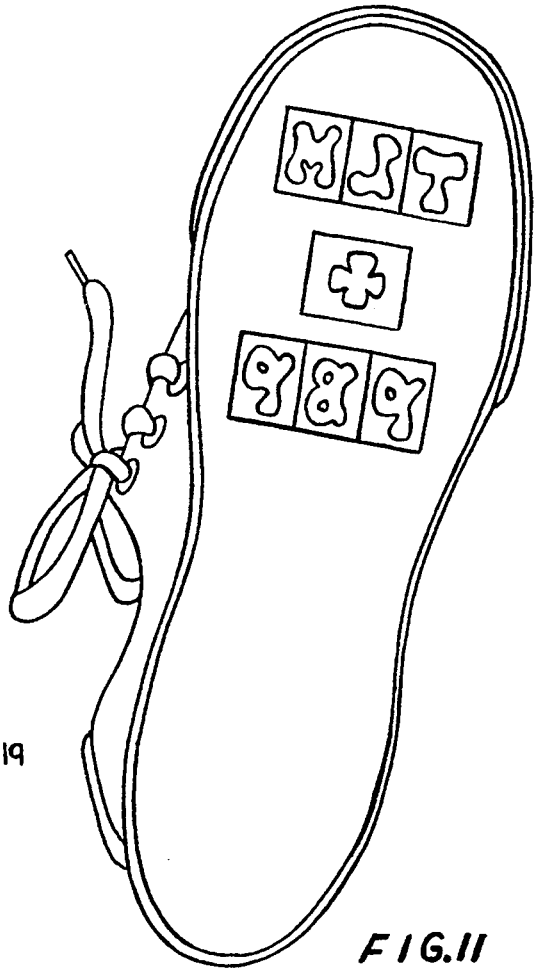
FIG. 11 shows yet another layout for footwear sole track.

FIG. 11 shows yet another design variation for a sole track. This would accommodate the same insert letter type 20A–20Z. Also note the + sign. Loose type could be made for any popular sign, as well as number.

Personalized signature shoes will be sold with an empty sole track shaped in a circular, noncircular or combination. The consumer will purchase type of their choice to fit their sole track. The statement they wish to make will be left as footprints as in FIG. 8. Additional type can be purchased when they wish to change their message.

Looking at FIG. 1 you will see the letter type appear to be backward. They are a mirror image of the footprint that will be left on the ground. To prove this, hold FIG. 1 in front of a mirror and you will see the letters are in the correct position. Using a mirror at first will be helpful in lining up the letter type for the sole track.

The letter type 20A–20Z and emblem type 42 can be snapped into place by first lowering type into one side of their sole track and snapping the other side into place.

When using letter type 20A–20Z it will be helpful to use centering line scale 19 in the sole track 18 of FIG. 10. Starting from the center point which will be zero, $\frac{1}{4}$ inch lines will mark the distance. Numbers will mark the lines for 1 inch, 2 inch, 3 inch and so on. To center your letter type 20A–20Z into sole track 18 you must leave the same number of centering lines on each side. This leftover space on each side will be filled by using blank insert 26. The blank insert 26 will be made in strips or a roll form. The consumer will be able to purchase blank insert 26 in small pieces to complete the sole track 18. Cutting the blank insert 26 will be done with a tin snip type of scissor.

If the consumer desires to change the message, removal will simply involve using a small screw driver. Inserting the small screw driver into notch 22 (FIGS. *9a, 9b, 9c*) and lifting will pop letter type out of the sole track 18. If consumer desires a permanent message, letters can be cemented in place.

The type and track can be standardized so that there will be a need for only two sizes, adult and children. Sole track 18 doesn't have to be limited to just letter type 20A–20Z. Number type, plus sign type, heart type are just a few of the many possibilities. By combining the different types, phrases can be concocted that would be similar to the type seen on auto license plates.

Accordingly, the reader will see that Personalized Signature Shoes will provide many advantages over prior art inventions. My new invention will be economical to produce, because of its interchangeability. Snapping inserts into place or replacing them will be a simple procedure. But best of all, there will be an unlimited number of possible messages making this product attractive to people of all ages. This will also give the retailer follow-up sales as the consumer changes their messages.

While my above description contains many specifications, these should not be construed as limitations on the scope of my invention, but rather as an exemplification of one preferred embodiment thereof. Many other variations are possible. For example trendy sayings could be made, molded in one solid line to fit as one unit into sole tracks. Another possibility could be supervised activities where school children would leave their messages on school playgrounds, walls of rooms, or toys by merely rolling paint over the shoe bottom and pressing against the surface to be marked. An even further exotic use would be for astronauts. The bottom of the astronaut's shoes would have a track across the shoe in an east to west direction near the ball of the foot. As the astronaut walks, his shoe bends at this point opening the track releasing or opening for holding rail which would be shaped to accommodate the track and hold in place when shoe is flat. The holding rails could be placed where astronauts wish to walk or stand to work on equipment.

For one final alternative style of my letter type 20A–20Z, there could be need for further locking the letters into place which could be accomplished by having a tongue and groove design on the sides of the letter type. This could be similar to the wooden boards used for flooring with its rounded tongues and grooves.

I claim:

1. An article of footwear for imprinting personalized messages on a ground surface below, comprising:

a. a flexible lower sole which is adapted to flex continually in use and including an elongated recessed track extending generally longitudinally of said lower sole, said track having closed ends and formed, longitudinally extending and spaced apart insert engaging portions;

b. a plurality of adjoining separate, generally rectangular inserts each having a surface with a symbol, and a pair of generally parallel side portions with respective, opposed outer surfaces which are cooperable with said insert engaging portions, respectively; and c. said inserts being received into said recessed track with only said opposed outer surfaces engaging said insert engaging portions of said recessed track, respectively, in a manner that said inserts are retained in said recessed track by only partial perimeteral engagement of said inserts therewith throughout said flexing of said lower sole in use.

2. An article of footwear as recited in claim 1 wherein said recessed track is beveled along said insert engaging portions thereof and wherein said outer surfaces of said inserts are correspondingly beveled to provide a tight fit thereof with said insert engaging portions, respectively.

3. An article of footwear as recited in claim 2 wherein said lower sole is of elastic material.

4. An article of footwear as recited in claim 2 wherein said insert engaging portions are beveled both outwardly and inwardly.

5. An article of footwear as recited in claim 1 together with blank insert means insertable in said track and cooperable with the first-mentioned inserts to completely fill said track between said closed ends.

6. An article of footwear as recited in claim 1 wherein said recessed track bears a scale to facilitate centering of said inserts.

7. An article of footwear recited in claim 1 wherein said inserts are snap-fitted to said recessed track.

8. An article of footwear as recited in claim 1 wherein said outer surfaces of said inserts are rounded and wherein said insert engaging portions of said track are correspondingly rounded to provide a tight fit therebetween.

9. An article of footwear as recited in claim 1 wherein said outer surfaces of said inserts are doubly rounded to provide a tight fit with said insert engaging portions, respectively.

10. An article of footwear as recited in claim 1 wherein at least some of said inserts include a notched opening to facilitate removal of said inserts individually from said recessed track.

* * * * *